United States Patent [19]

Winch

[11] 4,231,129

[45] Nov. 4, 1980

[54] APPARATUS AND METHOD FOR IMPREGNATING A DRY FIBER BATT

[75] Inventor: Allen R. Winch, Westfield, N.J.

[73] Assignee: Cotton, Incorporated, New York, N.Y.

[21] Appl. No.: 24,533

[22] Filed: Mar. 28, 1979

Related U.S. Application Data

[63] Continuation-in-part of Ser. No. 859,167, Dec. 9, 1977, Pat. No. 4,158,297.

[51] Int. Cl.[3] ..... D06B 5/08; D06B 21/00; D06B 23/18

[52] U.S. Cl. ..... 8/149.1; 8/149.3; 68/5 E; 68/158

[58] Field of Search ..... 8/149.1, 149.2, 149.3; 68/5 D, 5 E, 158; 118/65, 67

[56] References Cited

U.S. PATENT DOCUMENTS

| | | | |
|---|---|---|---|
| 1,410,256 | 3/1922 | Johnson et al. | 68/5 B |
| 2,539,947 | 1/1951 | De Klerk | 68/158 X |
| 3,291,639 | 12/1966 | Flowers et al. | 118/67 X |
| 3,730,678 | 5/1973 | Wedler et al. | 8/149.1 |
| 3,838,968 | 10/1974 | Fleissner | 68/5 D X |
| 4,136,535 | 1/1979 | Audas | 68/5 E |

*Primary Examiner*—Philip R. Coe

*Attorney, Agent, or Firm*—Burns, Doane, Swecker & Mathis

[57] ABSTRACT

A method and apparatus for impregnation of a dry fabric is disclosed including a purging device which is provided immediately upstream of a supply of liquid within an impregnation tank. The purging device urges a condensable gas through the dry fabric immediately prior to entry of the fabric into the liquid with the purging device providing a pressure differential across the fabric. The fabric is preferably conveyed by a first endless conveyor belt through a passageway of the purging device and subsequently into the impregnating liquid and beneath a first squeeze roller. The purging device displaces the non-condensable gas or air within the fabric with a condensable gas preferably steam.

24 Claims, 7 Drawing Figures

26
150
140
50
118
130
116
102
24
104
100
154
156
158
160
120
132
14
28
12
34
26
24
22
55

APPARATUS AND METHOD FOR IMPREGNATING A DRY FIBER BATT

BACKGROUND OF THE INVENTION

This application is a continuation-in-part of my copending application Ser. No. 859,167 entitled IMPREGNATOR/RINSER and filed on Dec. 9, 1977, now U.S. Pat. No. 4,158,297, patented June 19, 1979.

The present invention relates generally to a method and apparatus for impregnating a fabric and more particularly relates to a method and apparatus for rapidly removing air from a dry fabric during impregnation in a wet-on-dry impregnation stage of a continuous treatment system for the fabric.

Non-woven batts or webs, especially greige (unscoured) cotton non-woven batts, are conventionally treated in processes including a liquid impregnation and/or washing of the non-woven batt. Such processes typically begin with a "wet-on-dry" liquid application stage wherein the non-woven fiber batt (hereinafter referred to as a batt) is fed into a tank of a first liquor. The wet batt is then typically passed through the nip of a pair of high expression nip rolls following the wet-on-dry impregnation to reduce the amount of liquid or treating "liquor" pick-up to some predetermined level.

Various problems are encountered during the "wet-on-dry" impregnation in that the non-woven fiber batt does not perfectly absorb the liquor during the first impregnation stage. If the batt does not completely absorb the liquor during the first impregnation stage, serious distortion and damage may result in the batt, especially as the batt passes through the nip of a pair of high expression nip rolls. Such paired nip rolls are typically placed between the first impregnator stage and subsequent wet processing stages of a continuous treatment system for the fibrous batt.

Typically, a greige (unscoured) cotton fiber batt is conducted into an aqueous solution of caustic soda (sodium hydroxide). The immersion of the cotton fiber batt into the caustic soda solution provides the first impregnation of the dry fiber batt. In such immersions, it is not uncommon for a middle layer of the fiber batt to include entrapped air even after the batt has been immersed in the aqueous solution. The caustic soda solution must displace a relatively large amount of air during the initial wetting of the fiber so as to attempt to completely fill all of the voids within and between adjacent fibers with the caustic soda solution. The problem of entrapped air in the fibrous batt is especially likely to occur during this first impregnation of the dry batt and is substantially less likely to occur during a "wet-on-wet" impregnation. During a wet-on-wet impregnation, a first liquor is being replaced by a second liquor. Therefore, the likelihood of replacing the first liquor with air rather than with the second liquor is much less likely to occur.

The difficulty with wetting the dry cotton batt is especially present with cotton which is unscoured and still in its natural state. Such cotton contains a relatively large amount of natural oil, fat and wax on the surface of the fibers which all cooperate to impart a high degree of water repellancy to the fiber. These fats, waxes and hydrophobic oils make it especially difficult to wet a greige cotton batt with an aqueous solution. Naturally, the problem of entrapped air is more likely to occur in the case of non-woven, batt-like fiber assemblies having a relatively heavy weight and a relatively large degree of bulkiness than in the case of more densely assembled fibers, e.g., in woven and knit fabrics, although the problem also occurs with these fabrics and with fabrics of both natural and man-made fibers. Non-woven fiber assemblies typically contain a higher ratio of air per unit mass of fiber and are also generally much weaker in terms of tensile and cohesive lamellar strengths when compared with woven and knit fabrics. Accordingly, the problems associated with entrapped air are both more prevalent and more destructive in non-woven batts of greige cotton than in woven and knit fabrics. The problem of entrapped air pockets, however, occurs to some extent in all of these fabrics.

In order to more quickly and completely wet a fabric, it is known to utilize a wetting agent in many textile wet finishing processes. The wetting agents are added in small quantities to the various aqueous scouring, bleaching and dyeing liquors. The use of wetting agents generally increases the speed with which the fabric may be wetted by the treating liquor. Such an increase in speed typically removes air which is entrained within either the fiber, the yarn or the fabric at a relatively higher rate. The wetting agents commonly used are typically surfactants which have the effect of lowering the surface tension of the treating liquor.

Although the wetting agents used with aqueous caustic soda solutions are effective in increasing the rate at which the fabric is wetted by the solution, the problem of air pockets still exists. The air pockets are especially likely to form in the centrally disposed inner fiber layers within the greige cotton fiber batts (especially those batts weighing approximately twelve ounces or more per square yard) even with the use of wetting agents. The troublesome air pockets which still form within the greige cotton batts tend to grow larger as the batt is subjected to either low pressure nips or to high expression squeeze rolls during the fiber treatment process and accordingly the destructive effects of the entrapped air pockets increase correspondingly.

The use of a repetitive squeeze action during a first impregnation of a dry cotton batt has been found to assist in the elimination of air bubbles or air pockets from the greige cotton batt. Nevertheless, even the combination of the use of wetting agents with the use of repetitive squeezing of the batt within the first impregnation tank has not been found to be effective in eliminating all or enough of the trapped air within the non-woven cotton batts. This is especially true in the case of relatively fine micronaire (low linear density) cotton fiber mixes which resist rapid thorough wetting. Cotton batts have relatively shorter fiber length and/or a lower fiber length uniformity ratio have a lower inherent strength and, accordingly, a higher susceptibility to the disrupting effects of a bursting of the entrapped air pockets. The greige cotton batt typically blisters whenever the pockets of air are forceably expelled from the batt by a pair of high expression nip rolls which are typically found at the end of the first impregnator tank.

Holes or deformed, weakened areas which typically result from the bursting of the entrapped air pockets tend to grow larger as the processing of the batt proceeds. The holes or weakened areas tend to grow larger especially as the batt is being conveyed from a conveyor belt to a pair of high expression nip rolls and then onto the next conveyor belt. The number of the holes and the extent of non-uniformity in area density of the batt together have a direct influence on the uniformity of the wet treating process of impregnation and rinsing. Furthermore, these factors have a direct influence on the uniformity of the drying of the fibers as the fiber batt passes, for example, over heated drying drums or through a hot air dryer.

Especially in the case of greige cotton fiber, the conventional methods of reducing entrained air pockets are generally either not technically feasible or not economically feasible for the treatment of non-woven batts. In the case of woven or knit fabrics, the period of time that the woven or knit fabrics spend within the first wet-on-dry impregnating liquor can be increased as desired by increasing the path length of the fabric within the liquor. This may be accomplished by increasing the length and number of sinuous passes of the fabric in a conventional "wash box" configuration.

Space limitations and economic restraints which are associated with greige cotton fiber treatment require that the path length of the fibrous batt through the first impregnation liquor not be extended to the degree necessary in order to completely remove entrapped air with the use of wetting agents along.

Other known attempts at eliminating or reducing the occurrence of air pockets within a fabric in a wet-on-dry impregnation step include the use of a vacuum chamber immediately prior to immersion of the fabric into the first impregnation liquor. In such arrangements, the fabric is passed through a vacuum chamber preferably having a relatively high vacuum in order to remove as much of the air within the fabric as possible before wetting the fabric with the first impregnation liquor. Such arrangements have not been completely satisfactory in eliminating the formation of air pockets within cotton fiber batts since it is difficult to provide a sufficient vacuum which is adequate to remove enough air to prevent the formation of air pockets. Furthermore, the use of high vacuum slots to remove air from the dry cotton batts requires sophisticated, high cost and troublesome equipment such as a high vacuum pump, a specially designed conveyor belt (or foraminous cylinder) and high pressure seals at fabric entrance and exit ports.

Arrangements including a vacuum chamber to remove air from a fibrous batt immediately prior to impregnation are disclosed in U.S. Pat. No. 3,644,137 issued to Fox et al on Feb. 22, 1972 and 3,730,678 issued to Wedler et al on May 1, 1973.

In another known arrangement, a long strip of cloth is passed over a "steamer" consisting of a vertically oriented, U-shaped receptacle. A screen is provided across the top of the receptacle with the fabric strip being passed horizontally over the upper end of the receptacle. The strip of cloth is then conveyed from the receptacle vertically downwardly into a tank and finally into a supply of liquid within a tank. Such an arrangement is disclosed in U.S. Pat. No. 1,410,256 which issued to Johnson et al on Mar. 21, 1922.

In another known arrangement, a running web of a textile material is passed into a sealed chamber which is provided with steam. The web is conducted into a supply of liquid after traveling within the sealed steam chamber for a predetermined distance. An arrangement such as is disclosed in U.S. Pat. No. 3,955,386 which issued to Meier-Windhorst on May 11, 1976, supplies steam to the sealed chamber so as to completely surround the web of the textile material.

A process is also known for batch dyeing of fibers utilizing high pressure sealed vessels. Very highly pressurized steam is utilized in an essentially isothermal process to dye to the fibers. Such a process is described in U.S. Pat. No. 4,082,502 issued to von der Eltz et al on Apr. 4, 1978.

Still other known arrangements for treating fiber batts include those described in U.S. Pat. No. 956,550 issued to Todd et al on May 3, 1910; U.S. Pat. No. 971,575 issued to Todd et al on Oct. 4, 1910; U.S. Pat. No. 797,659 issued to Baron on Aug. 22, 1905; U.S. Pat. No. 1,209,465 issued to Matter on Dec. 19, 1916; and 2,785,042 issued to Grajeck et al on Mar. 12, 1957.

None of the known arrangements and methods, however, has been found to be adequate in eliminating or sufficiently reducing the problem of entrained air in fabrics especially in a greige cotton batt.

Accordingly, it is an object of the present invention to provide a method and apparatus for impregnating a dry, moving fabric with fluid wherein the formation of entrapped air pockets is substantially reduced or eliminated.

Another object of the present invention is to provide a method and apparatus for impregnating a dry, moving fiber batt wherein the density uniformity and strength of the fiber batt is substantially increased as a result of a lessened formation of air pockets within the batt.

Yet still another object of the present invention is to provide a method and apparatus for completely impregnating a dry, moving fabric with a first impregnation liquor in an efficient and economical manner.

Finally, it is an object of the present invention to provide a method and apparatus which substantially avoids or alleviates the problems of the prior art.

An apparatus which satisfies these and other objects includes a tank for containing a first impregnation liquor. A conveying device, for example a first endless conveyor belt, is provided for conveying the fiber batt into and out of the tank of fluid. A purging device is provided immediately upstream of the impregnation liquor with the purging device urging a condensable gas through the dry fabric immediately prior to the entry of the fiber batt into the impregnation liquor. The fabric passes from the purging device into the liquor before essentially any of the condensable gas has condensed within the fabric. The purging device provides a pressure differential for the condensable gas across the fabric. The condensable gas is preferably steam which condenses immediately upon entry of the fabric into the relatively cool liquid. The condensation of the steam while the fabric is within the liquid creates a sufficient vacuum within the fabric to draw the first impregnation liquor into the fabric to completely or nearly completely wet the fabric.

In more preferred embodiments of the present invention, the purging device includes a first chamber member which is provided on the first side of the fabric and a second chamber member which is provided on a second side of the fabric. Steam is supplied to the first chamber member at a first predetermined pressure. The second chamber is maintained at a second predetermined pressure in order to facilitate the removal of air and surplus steam from the work area. The second predetermined pressure is preferably negative with respect to the ambient atmosphere and with respect to the first predetermined pressure. The first and second chamber members are preferably sealed with respect to the fabric so as to minimize both the escape of steam out of the purging device and the entry of ambient air into the purging device.

A first roller member is preferably provided closely adjacent to the purging device with the fabric being squeezed between the first endless conveyor belt and the first roller member. A second roller member may be provided downstream of the first roller member so as to urge the conveyor belt against the first roller member.

BRIEF DESCRIPTION OF THE DRAWINGS

In order that the invention may be more readily understood, reference is made to the accompanying drawings in which like numerals refer to like elements and in which.

DETAILED DESCRIPTION OF THE PRESENT INVENTION

The process and apparatus of the present invention is intended to achieve a high degree of "liquor-for-air exchange" efficiency for wet-on-dry impregnations of textile fabrics and especially of heavy weight non-woven fiber batts in a manner which will not significantly disrupt, tear or rupture the fabric and which will significantly reduce the quantity of wetting agents, eliminate the need for high vacuum equipment, and reduce the number of pairs of high expression nip rolls, conveyor belts, liquid circulation pumps and agitators, etc., which would otherwise be needed.

An "ideal" wet-on-dry impregnation process is one which will completely replace air or other gases (entrained in the dry fabric entering the impregnation vessel) with treating liquor in a relatively short time, i.e., on the order of a few seconds. The "ideal" process will not disrupt nor entangle fibers in a batt, nor weaken, tear or rupture the batt as the batt passes through the process. Although it is recognized that any actual, real process is not likely to achieve the perfection sought in the ideal process, the improved process and apparatus of the present invention approaches the ideal process more effectively and with simpler, less expensive means than any other known process or apparatus.

Although the process and apparatus of the present invention may be utilized in any process requiring a dry fabric of natural or man-made fibers to be immersed in a liquor in a liquid impregnator, rinser or washer, it is hereinafter described in conjunction with a representative cotton fiber treatment.

Figure 1:
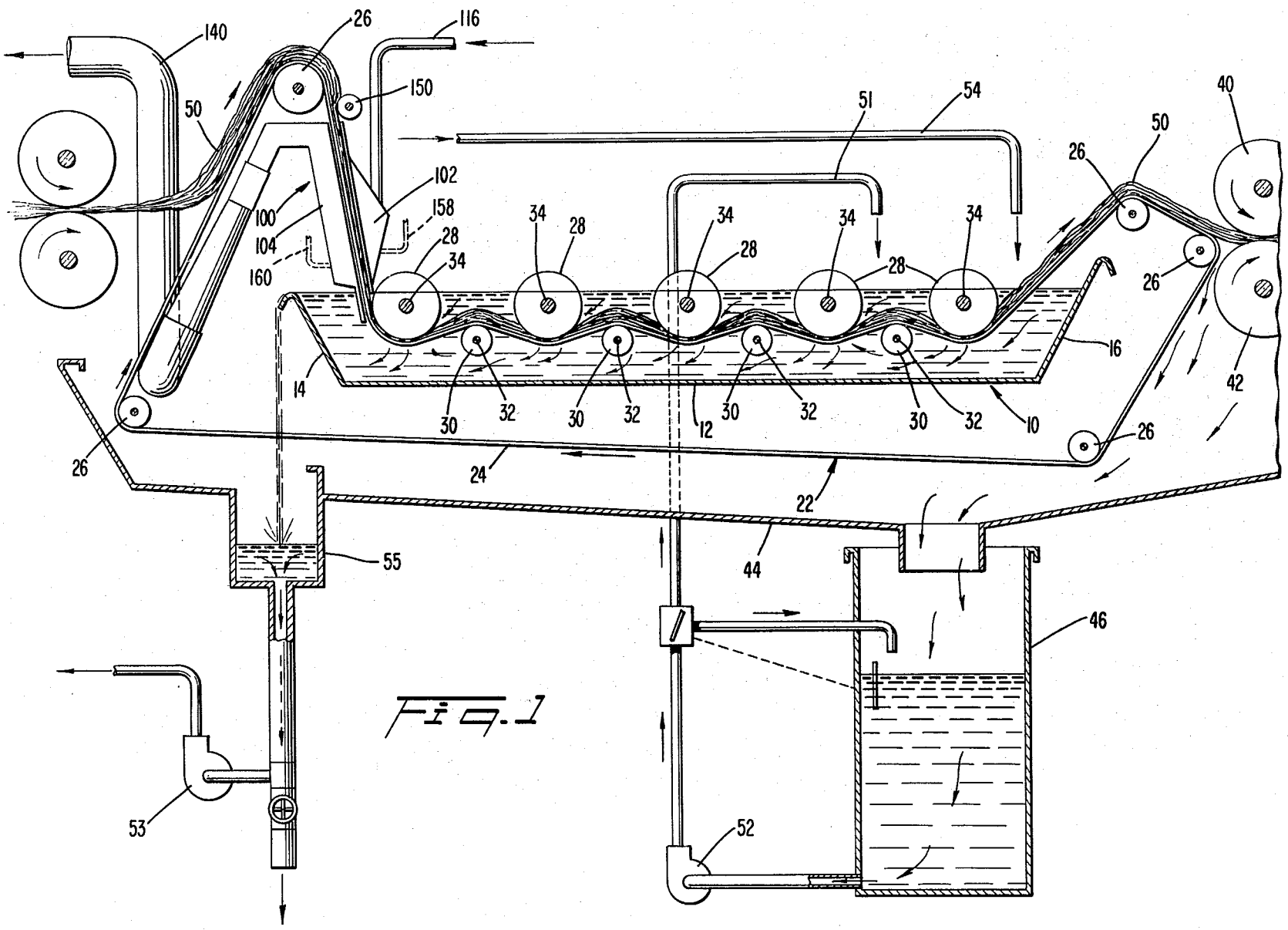
FIG. 1 is a cross-sectional view of an apparatus according to the present invention.

With reference now to FIG. 1 of the drawings, a first embodiment of the apparatus of the present invention which may preferably be used as an impregnator for a dry, non-woven batt includes a longitudinal tank 10 having a bottom member 12 and a pair of endwalls 14, 16. A pair of side walls (not shown) are joined both to the endwalls and to the bottom member to form a container for fluid which is substantially longer than the width of the tank.

In the present invention, it may be desirable to provide a countercurrent flow for the fluid within the tank. Accordingly, the endwall 14 which forms a front wall for the tank is lower in height than the other endwall 16 which forms the back wall for the tank. When the tank is supplied with fluid, the fluid will flow over the front wall 14 before flowing over the back wall 16. The side walls (not shown) each include a top edge which extends from the top of the front wall to the top of the back wall such that the upper liquid level will be effectively contained in the tank as it flows by gravity in a generally horizontal fashion which is inclined downwardly towards the front wall 14.

A perforate endless conveyor 22 includes a belt 24 which travels in a continuous path around the longitudinal tank 10. In the arrangement shown in FIG. 1, the belt 24 travels on a plurality of rollers 26 arranged below and at either end of the longitudinal tank. One or more of the rollers 26 is connected by suitable gearing (not shown) to an electric motor (also not shown) to provide a driving force for the belt 24. The belt travels in a generally clockwise direction with the belt moving from the front wall 14 towards the back wall 16 within the longitudinal tank.

A purging device 100 is arranged at a first end of the tank to purge the noncondensable air from within the batt with a condensable gas such as steam. The batt is then conveyed immediately into the impregnation liquor where the condensable gas condenses to create a vacuum within the batt. The vacuum draws the liquor into the batt to completely or nearly completely wet the batt.

The batt 50 is carried by the first conveyor belt 24 into a passageway provided between a first chamber member 102 and a second chamber member 104 of the purging device 100. The passageway of the purging device 100 has a width which is substantially identical to the width of the batt, i.e., typically 42 inches wide. The spacing between the first and second chambers 102, 104 of the purging device is determined by the thickness of the batt and may be varied as desired.

One of the chambers 102, 104 may be resiliently mounted with respect to the other chamber by a device (not shown) so as to gently urge the first chamber against the second chamber in order to seal the purging device with respect to the batt. It is important, however, that the purging device does not disrupt the batt or disrupt the travel of the batt through the purging device.

Figure 4:
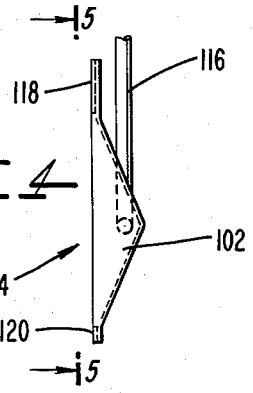
FIG. 4 is a side view of another portion of the purging device of FIG. 2.
Figure 5:
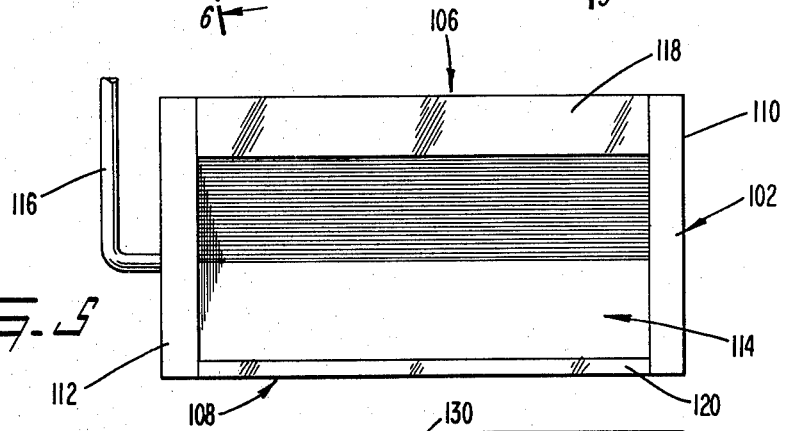
FIG. 5 is a view along the line 5—5 of FIG. 4.

The first chamber 102, with reference now to FIGS. 4 and 5, has a rectangular frame which faces on one side of the batt. The frame includes a top member 106 and a bottom member 108 both of which are plate-like and provide a generally smooth surface for the chamber 102 to abut against the fiber batt. Additional members 110 and 112 are provided on either side of the members 106, 108 so as to complete the plate-like frame of the chamber 102.

An opening which is defined by the members 106–112 provides a passageway 114 for steam supplied to the chamber 102 to communicate with the batt. The chamber 102, with reference especially to FIG. 2, has a generally triangular cross section so as to provide an interior volume which is enlarged in the vicinity of the passageway 114. A supply pipe 116 is provided in communication with the interior of the chamber 102 so as to supply an adequate volume of steam at a predetermined pressure to the chamber.

With reference again to FIG. 5, the frame of the chamber 102 may be provided with polytetrafluoroethylene (PTFE) (e.g., Teflon or more preferably Rulon) seals especially along both an entrance edge and an exit edge of the frame. The seals 118, 120 provide a low friction surface for the batt or for an upper brattice or belt (if used) and help to prevent an escape of the steam through the passageway of the purged device to the ambient air. Seal members may optionally also be provided along the sides of the frame to minimize loss of steam at the edges of the passageway for the batt. If it is desired, the edges of the first and second chambers may also be sealed together along the sides of the passageway of the batt.

The second chamber 104 (see FIG. 2), if provided, is arranged adjacent to the first chamber 102 on the other side of the batt. The endless conveyor belt 24 preferably travels around an outside surface of the second chamber 104 with the roller member 26 provided to convey both the belt and batt into the passageway of the purge device.

Accordingly, the second chamber 104 may be provided with an inverted trough shape as illustrated in the figures. Other configurations for the first and second chambers are contemplated as being within the present invention and the chambers may be arranged in any suitable manner depending upon the physical configuration of the other members of the arrangement.

Figure 3:
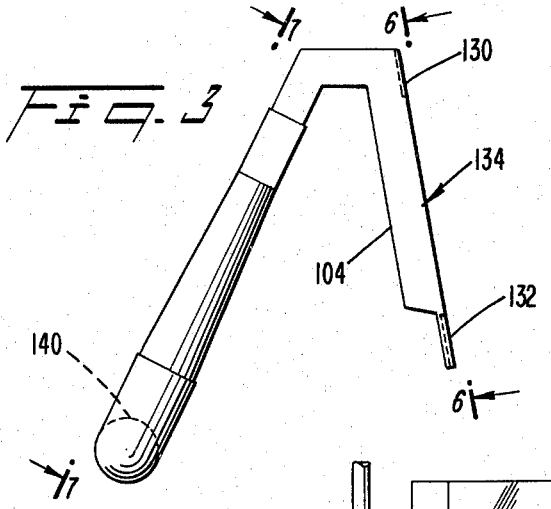
FIG. 3 is a side view of a portion of the purging device of FIG. 2.
Figure 6:
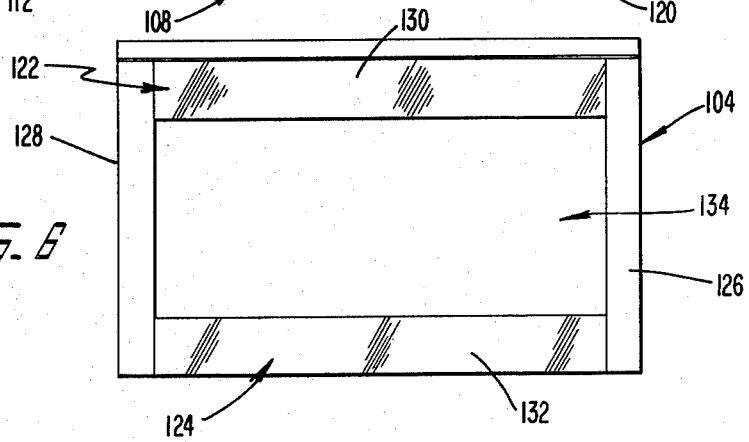
FIG. 6 is a view along the line 6—6 of FIG. 3.

With reference to FIGS. 3 and 6, the second chamber has a rectangular frame similar in structure to the frame of the first chamber 102. Top and bottom frame members 122 and 124 cooperate with a pair of side members 126, 128 to provide a generally planar surface for contacting the conveyor belt and/or the batt. The frame members together define a passageway 134 for the chamber.

Upper and lower polytetrafluoroethylene (PTFE) seals 130, 132 may be provided so as to provide a low friction surface for carrying the conveyor belt 24. Furthermore, the polytetrafluoroethylene (PTFE) seal members 130, 132 help to prevent or decrease an escape of steam from the purging device 104 to the ambient air. As with the first chamber, seal members may optionally also be provided along the sides of the frame of the second chamber to minimize the entry of air into the second chamber.

Figure 2:
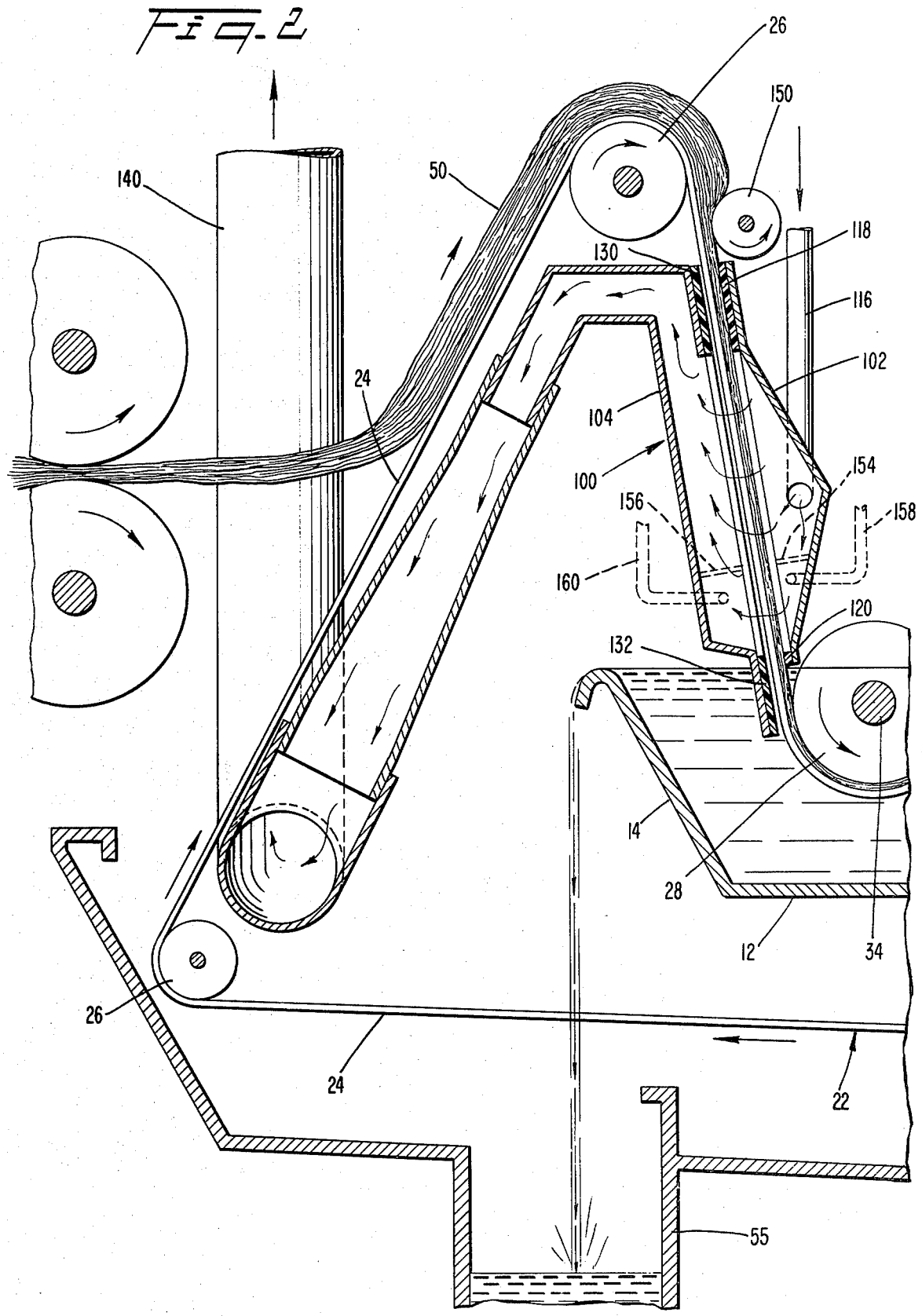
FIG. 2 is an enlarged cross-sectional view of a side portion of the apparatus of FIG. 1 including the purging device with the fiber batt and also including a modification of the apparatus illustrated in phantom.
Figure 7:
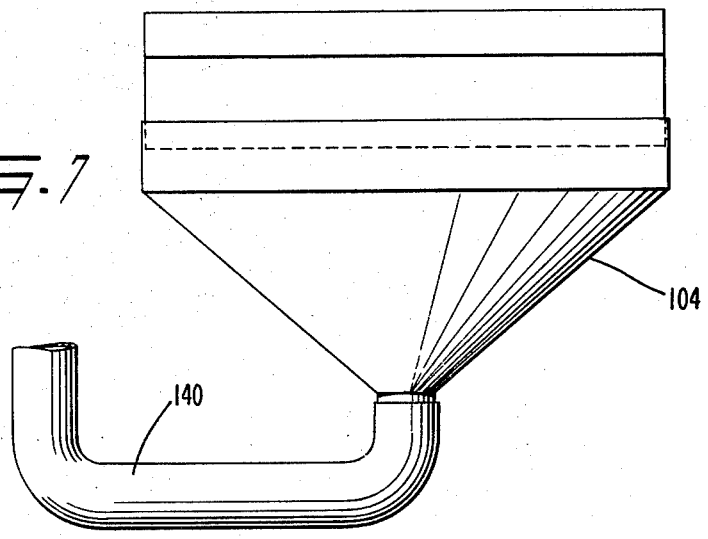
FIG. 7 is a view along the line 7—7 of FIG. 3 showing the transition from a rectangular duct to a circular duct.

The second chamber 104, with reference to FIG. 2, has a generally rectangular cross section in the vicinity of the frame and a passageway 134. The generally rectangular cross section undergoes a transition to a circular duct downstream of the passageway 134 (see FIG. 7). In this way, the second chamber 104 may communicate with a circular duct 140 which provides the vacuum within the chamber.

With reference again to FIG. 2, a turn roller 150 or another suitable device such as a guide plate or chute (not illustrated) may be provided immediately upstream of the entrance of the purging device 100 so as to guide the batt 50 into the entrance of the purging device. In this way, the batt may be gently compressed so as to reduce the thickness of the batt before passing between the members 118 and 130.

Furthermore, it may be desirable in some instances to terminate the region of pressure differential across the batt at some distance above the entry of the batt into the liquor. Accordingly, a chute or transfer duct (illustrated in phantom) which extends in the machine direction from the purge device may be provided.

It is essential that any significant condensation of the condensable gas does not occur in the presence of a noncondensable gas (air). Therefore, the chute or transfer duct (formed by the walls 154, 156, illustrated in phantom, and a lower portion of the chambers 102, 104) serves to prevent the ambient air from coming in contact with the batt 50 containing the condensable gas.

In the event that some of the condensable gas should actually condense within the chute or transfer duct, additional condensable gas could enter the chute or transfer duct from the purge device 100. Furthermore, steam may be added to the chute or transfer duct on both sides of the batt by steam supply pipes 158, 160. In this way, even though the pressure of the condensable gas may be identical on both sides of the batt downstream of the purging device, the condensable gas will not be displaced by noncondensable gas. Instead, condensation of the condensable gas will either draw additional condensable gas or the impregnation liquid into the batt.

Of course, once the batt 50 has passed through the purge device and has been subjected to the pressure differential to displace the noncondensable gas (air) with the condensable gas (steam) the batt may be conveyed for some distance within a condensable gas environment prior to actual immersion within the impregnation liquid. So long as the batt is not exposed to a noncondensable gas to a significant extent between the purging and impregnation with liquid, the batt is considered to be "immediately" immersed within the liquid after being subjected to the pressure differential. It is preferable, however, that the batt pass directly from exposure to the pressure differential into the impregnation liquor so as to minimize the amount of condensable gas required in the present invention.

In other embodiments of the apparatus, the conveyor belt 24 may be eliminated or a second conveyor belt (not shown) may be provided on another side of the batt. If two conveyor belts are provided, the second conveyor belt may travel within the passageway of the steam purging device along with the batt and the other belt. Alternatively, the second conveyor belt may contact the fiber batt downstream of the purging device, for example, at one of the rollers 28 arranged downstream of the purging device.

The conveyor belt 24 and, if provided, a second conveyor belt preferably are perforate so as to provide communication between the first chamber and the second chamber and to thereby permit steam to pass through both the batt and the one or two belts into the second chamber.

Although the purging device of the present invention may be used with an impregnation tank without any rollers within the tank, it is generally advantageous to pass the batt beneath at least one roller 28 within the tank. Furthermore, in some arrangements, advantages may result from combining the steam purging device with the impregnation/rinser invention disclosed in my co-pending application Ser. No. 859,167 of which this application is a continuation in part. Accordingly, the present invention is illustrated in FIG. 1 and described hereafter in conjunction with a series of squeeze and cooperating rollers.

A series of squeeze rollers 28 may be arranged within the tank in a generally planar configuration with each of the rollers 28 being cylindrically shaped and having an axis 34 which is transverse to the direction of travel of the belt 24. All of the axes of the squeeze rollers are parallel both to one another and to the bottom member 12 of the tank. The axes 34 are mounted at either end in the side walls of the tank to permit each squeeze roller to freely rotate about the respective axis.

The belt 24 conveys a non-woven batt 50 from a preceding stage in a fiber treatment process such as a consolidated batt forming stage into the longitudinal tank by way of the purging device 100. The batt 50 is carried throughout the longitudinal tank on an upper surface of the belt 24 so that the batt is always above the belt.

A series of singular or cooperating rollers 30 are arranged within the tank in a generally planar configuration spaced alternately between the squeeze rollers 28. Each of the cooperating rollers 30 is cylindrically shaped and has an axis 32 which is transverse to the direction of travel of the belt 24. The cooperating rollers are oriented with the squeeze rollers so that a top surface of each of the cooperating rollers is both between adjacent squeeze rollers and above lower surfaces of the adjacent squeeze rollers.

The belt 24 travels in a winding path alternately beneath the squeeze rollers and above the cooperating rollers. After passing above the front end 14 of the tank, the belt 24 carries the batt 50 beneath the first squeeze roller 28 where the web is gently squeezed in a nip defined between the belt and the roller. The perforations of the belt permit a large fraction of the fluid which has been absorbed by the batt to be squeezed out of the batt. Generally, the squeeze roller 28 reduces the gross fluid volume contained in the batt to about $\frac{1}{8}$ or about $\frac{1}{2}$ of the unsqueezed gross wet fluid volume, and more frequently from about $\frac{1}{4}$ to about $\frac{1}{3}$, without substantially detrimentally affecting the cohesiveness of the non-woven batt. Immediately after the batt has passed beyond the first squeeze roller, the batt then absorbs additional fluid to replace the fluid removed during squeezing.

The travel of the batt 50 under the first squeeze roller 28 reduces the cross-sectional thickness of the batt as a result of forces exerted by the belt 24 in a direction towards the axis 34 of the squeeze roller. As the belt passes beneath the squeeze roller, a tension provided throughout the entire length of the belt is comprised of tangential and radial components with the radial component reaching a maximum value at a lowermost portion of the squeeze roller. It is at the lowermost portion of the squeeze roller, therefore, that the batt undergoes the greatest compression between the belt 24 and the surface of the squeeze roller 28. After the batt has traveled beyond the lowermost portion of the squeeze roller, the radial component of force exerted by the belt on the web decreases. The radial component of force is equal to zero when the batt is no longer in contact with the surface of the squeeze roller.

As the batt is carried by the belt 24 from the squeeze roll 28 to the adjacent cooperating roller, the batt is free to readily absorb fluid from the longitudinal tank. The cross-sectional thickness of the batt increases to a maximum extent when the batt is completely saturated with fluid.

As the batt is conveyed throughout the longitudinal tank, the batt is repeatedly squeezed while passing between a squeeze roller and the conveyor belt 24. The batt is allowed to absorb fluid between the series of intermittent squeezes and becomes completely saturated while passing between successive squeeze rollers.

From the last squeeze roller, the batt is carried by the belt up and over the back end 16 of the tank to a pair of high-expression nip rolls 40, 42 which remove most of the fluid from the batt before the web leaves the apparatus of the present invention. Generally, depending upon the next treatment to which the non-woven batt will be subjected, the nip rolls will remove the fluid in the batt to a level of from about 60 percent to about 300 percent, WPU, preferably from about 80 percent to about 150 percent, WPU (meaning 0.6 to about 3 pounds of liquor per pound of dry fiber in the batt, preferably from about 0.8 to about 1.5 pounds of liquor per pound of dry fiber in the batt).

With continued reference to FIG. 1, a collecting pan 44 which is located beneath both the longitudinal tank 10 and the conveyor 22 receives fluid which is removed from the batt by nip rollers 40, 42. This fluid is recycled to the longitudinal tank 10 via a sump 46, a pump 52 and a piping system 51 with the discharge orifice of 51 positioned preferably closer to end wall 16 of the longitudinal tank 10 to enhance countercurrent flow from the back wall 16 to the front wall 14. Since the front wall 14 of the longitudinal tank 10 is lower than the back wall 16, fresh liquor supplied by the orifice 54 also travels in a direction which is opposite to that of the moving batt within tank 10. Accordingly, a significant counterflow is obtained wherein the batt is progressively exposed to fresher fluid as the batt travels through the tank.

If the apparatus is used as a rinser for a dry batt, fresh rinse liquor may be added to the tank through an orifice 54 to flow generally countercurrent to the direction of the batt movement and overflow into a trough 55 connected either directly to the drain by gravity flow or, alternatively, to the inlet of a pump 53 from which a rinse effluent from tank 10 may be pumped to drain. Alternatively, if the apparatus is used as an impregnator to apply a treating liquor (such as a bleach or dye liquor), the trough 55 and the pump 53 are not required.

Although steam is preferably used as the condensable gas in the present invention, other condensable gases may be used. The condensable gas supplied by the first chamber of the purging device displaces the air (which is considered to be a non-condensable gas for the purposes of this discussion) within the batt. The condensable gas then immediately condenses upon entry of the fiber batt into the relatively cool impregnating liquor. The condensable gas must condense while the batt is immersed in the impregnating liquor because otherwise the resulting vacuum would cause air to return into the batt. The return of air into the batt would result in entrapment of air and the formation of undesirable air pockets which burst during later processing of the batt.

It is most preferable that a dry fabric be purged with the condensable gas immediately prior to the first immersion of the fabric into the liquor. It is relatively difficult to pass air or steam through a wetted fabric when compared with the ease of passing air or steam through a dry fabric. For example, if a scoured and bleached cotton batt is wetted with water so that approximately 16 ounces of cotton fiber contain about 16 ounces of water per square yard of batt, roughly ten times the static pressure drop is required through the thickness of the batt in order to produce a desirable gas flow rate through the batt. It has been found that no air will pass through the batt at all until the pressure differential across the batt, i.e., the static pressure difference as measured above and below the batt, exceeds a significant threshold level.

A reasonable air velocity which is on the order of about 100–140 linear feet per minute can be obtained in a dry cotton batt with a static pressure drop corresponding to about 5 inches of water. In order to obtain a comparable air velocity in a wetted cotton batt, a pressure drop of roughly 50 inches of water or more may be necessary.

If a dry batt is purged of air with a condensable gas, as in the present invention, a pressure differential of only about 1 inch of water or less may be necessary across the batt in order to sufficiently displace substantially all of the non-condensable air with the condensable gas. Preferably, a sufficient pressure differential will be maintained across the batt so that the absolute pressure within the batt will not drop below ambient atmospheric pressure. The second chamber serves to exhaust both the air and surplus steam from the batt so as to remove the warm, humid gas mixture from the work area.

The frame portion of the first and second chambers, in addition to preventing an escape of steam into the ambient air, also assists in preventing a flow of the ambient air into the second chamber provided with the vacuum. In order to further seal the first and second chambers, it is preferable to arrange the chambers so as to end within the tank of liquid. In this way, it is preferable to maintain a predetermined level of liquor within the tank and to arrange the first and second chambers so as to extend into the liquid to a relatively small extent. As described above, a chute or transfer duct may be provided between the purging device and the level of liquid so as to maintain an environment of condensable gas around the batt. In this way, a displacement of the condensable gas with a non-condensable gas is minimized.

In order to adequately displace the non-condensable air of a typical fiber batt having a width of 42 inches, it has been calculated that approximately 0.097 to 0.139 LBM of steam condensate will be required per LBM of dry fiber batt in heating the conveyor belt and the fiber. Upon condensation, the volume of steam which replaces the air within the fiber batt will add approximately only 0.00876 LBM of condensate per LBM of dry fiber. The total steam condensate, however, will tend to heat up the impregnating liquor bath, for example, an alkaline liquor bath, during operation of the apparatus. The total steam condensate corresponds to about 10–14 percent of the weight of the dry fiber or approximately 100–140 BTU per pound of dry fiber passing through the alkali impregnator. It has been calculated that about one to one and one half pounds of fresh alkali make-up liquor must be added to the alkali impregnator for each pound of dry fiber passing through the impregnator.

It has further been calculated that the temperature of the alkali bath would slowly rise to a maximum equilibrium value which is roughly 67° F. to 140° F. above the input temperature of the make-up liquor assuming that no heat losses occur from the alkali impregnator. Since heat losses will result however from the walls of the alkali impregnator, especially as the temperature of the alkali bath rises, it is anticipated that the actual temperature rise of the liquor bath will be significantly less than the insulated temperature rise of 67° F. to 140° F. calculated hypothetically above.

Because of the heat added to the impregnation liquor and because of the preference to immediately condense the steam upon entry of the fiber batt into the liquor, it is preferable to arrange the tank of liquor so as to have an adequate heat sink capability. Ideally the tank of liquid should remain at a preferred temperature level even though heat is being added to the liquor by the condensable gas. Various devices and arrangements may be utilized to remove the excess heat from the liquor if necessary.

Furthermore, the total amount of steam which will pass into the exhaust duct has been calculated to vary from a theoretical minimum value of zero to an estimated value of 0.0351 LBM or more of steam per LBM of dry fiber. Accordingly, the amount of steam loss is calculated to constitute a very small amount, on the order of about 13 cubic feet more or less of steam per minute. It may be desirable to condense the steam within the exhaust duct at some point downstream of the second chamber.

In summary, then, the present invention discloses a device and process for impregnating a continuous moving fabric assembly of textile fibers (e.g., woven and knit fabrics, natural and man-made fibers, nonwoven webs or batts) in which a steam/air purging device is used to purge all, or a major portion, of the air filling the void spaces within and between fibers of an essentially dry fabric in such a manner that gaseous steam, at essentially ambient atmospheric pressure, fills all, or a major portion, of the void spaces formerly occupied by air. The steam/air purging device may preferably be comprised of a steam supply plenum positioned adjacent to one face (e.g., the top face) of the fabric. The steam/air purging device may optionally also include an exhaust plenum (for removing air and excess purging steam) which may be positioned adjacent to the other face (e.g., the bottom face) of the fabric and opposite the supply plenum.

Steam pressure which is applied to the steam supply plenum for purging the air from the fabric is a relatively small differential value above ambient atmospheric pressure, e.g., less than 10% above, and preferably less than 1.0% above, the ambient atmospheric pressure. The exhaust pressure (vacuum) applied to the exhaust plenum (if used) is a relatively small differential value below the atmospheric pressure, e.g. less than 10% below, and preferably less than 1.0% below, the ambient atmospheric pressure.

The steam/air purging device or an extension thereof must be arranged closely adjacent to the impregnating liquor bath in such a manner that the gaseous steam occupying the void spaces within and between the fibers of the fabric completely fills these void spaces until such time as the fabric becomes submerged in the treating liquor bath. Accordingly, the fabric may pass through a chute or transfer duct if the purging device does not extend immediately adjacent or into the impregnation liquor. The impregnating vessel may contain any desired treating liquid for impregnating the steam filled fabric which fabric then exits from the impregnating vessel.

Devices may be provided for maintaining the impregnation liquor bath at a temperature sufficiently below that of the saturation (hence condensation) temperature of an essentially 100% steam atmosphere at essentially the ambient atmospheric pressure (i.e., the ambient atmospheric pressure plus the small hydrostatic pressure head of the impregnating liquor bath surrounding the fabric as it passes through the impregnating liquor bath). The devices for maintaining the liquor temperature at a sufficiently low level may consist of sufficiently exposed uninsulated surface areas of the impregnation bath vessel walls to dissipate the heat released by the condensation of the purging steam (condensed within the fabric and upon associated fabric conveyor belts) at a temperature level sufficiently low to maintain a sufficiently rapid rate of steam condensation at the submerged interface between the hot saturated steam and the somewhat cooler impregnating liquor surrounding the submerged fabric.

Although it generally may not be necessary, additional heat exchange surface areas may be provided external to the impregnation vessel for additional cooling of the impregnating liquor. This supplemental external heat exchanger may be used merely to cool the impregnation liquor just before it is metered into the impregnation vessel, or this heat exchanger may be part of a liquor bath recirculation system. However, except in cases where it is desirable to maintain a significantly lower temperature in the main body of the impregnation liquor (e.g., to maintain chemical stability of the liquor bath in the impregnator), the exposed wall surface area of properly designed impregnation vessels fabricated from steel or stainless steel is sufficient to dissipate the heat given up by the relatively small mass of steam condensed per unit mass of fresh impregnating liquor consumed in a wet-on-dry impregnation process.

Accordingly, the process of the present invention is carried out at essentially atmospheric pressure, i.e., at approximately 14.7 pounds force per square inch, absolute pressure (14.7 psia), equivalent to the hydrostatic head absolute pressure of a column of water 407 inches deep (407 inches WC). The steam/air purging device employs an essentially 100% steam atmosphere supply plenum, in which the steam supply pressure is relatively low, (approximately +1.0 inch of water above atmospheric pressure). The steam supply plenum may preferably cooperate with a corresponding optional steam/air exhaust plenum. The steam/air exhaust plenum is attached to an exhaust fan capable of developing a small negative pressure (i.e., a slight vacuum below atmospheric pressure) of about 1.0 inch of water below atmospheric pressure. Hence the fabric is exposed to an atmosphere of 100% air at atmospheric pressure (approximately 407 inches of water, absolute) before the fabric enters the steam/air purging device.

Upon entering the steam/air purging device, the one (top) face of the fabric is exposed to an essentially 100% steam atmosphere in the steam supply plenum at a positive pressure of about 1.0 inch of water above atmospheric pressure. At the same time, the other (bottom face) of the fabric may be exposed to a negative pressure of about 1.0 inch WC below atmospheric pressure by an optional exhaust plenum for removing surplus steam. In this fashion all, or essentially all, of the air is removed (purged) from the void spaces within and between the fibers of the dry fabric as the fabric passes through the steam/air purging plenum.

The fabric exit port from the steam/air purge plenum or any extension thereof is so designed and closely positioned adjacent to the surface of the impregnating liquor bath that the fabric passes, completely devoid of air, directly from the steam/air purging plenum or any extending chute or transfer duct therefrom into and below the surface of the impregnating liquor with essentially no intermediate exposure to the ambient room air atmosphere. With such close positioning of the steam/air purging plenum fabric exit port or any extending transfer duct or chute adjacent to (or submerged below) the surface of the impregnating liquid, and with the use of a small positive pressure (of approximately +1.0 inch of water above atmospheric pressure) in the steam supply plenum, the process is sufficient to prevent ambient room temperature air from rushing back into the fabric void spaces to cause premature cooling and condensing of the gaseous steam contained in the fabric. Hence the fabric is still filled with gaseous steam and devoid of air as it leaves the steam/air purge plenum and plunges below the surface of the impregnating liquor bath. The absolute pressure exerted against the steam filled fabric as the fabric passes below the surface of the liquor bath is essentially equal to the ambient atmospheric pressure plus the small hydrostatic pressure added by the depth of the liquor bath surrounding the submerged fabric.

When the process is carried out at essentially ambient atmospheric pressure with the very small additional plenum steam pressures and hydrostatic pressures noted above, a further understanding of the importance of the conditions specified above becomes more apparent by examining the saturation pressures of 100% saturated steam for various temperatures. The saturation pressures (or vapor pressures) of saturated steam at various temperatures may be abstracted from standard steam tables to illustrate the relative potential vacuums which can be induced in situ within the fabric as the hot gaseous steam is cooled and condensed by the relatively cool impregnating liquid surrounding the submerged fabric. As evident from a study of the saturation pressures, the effect of temperature on the saturation (hence condensing) pressure of 100% steam is highly significant. For example, if the temperature of the impregnating bath surrounding the fabric rises above 180° F., the vapor pressure of saturated steam remains above 0.511 atmosphere (above 208 inches WC). However, if the temperature of the impregnating liquor bath is kept at 140° F. or below, the vapor pressure of saturated steam drops to 0.197 atmosphere (80 inches WC), or less. In other words, at 180° F. a hypothetical vacuum of only (1.000–0.511)=48.9% of the absolute vacuum can be induced by condensing steam to draw impregnation liquor into the batt. At 100° F., the vacuum created by condensing steam equals (1.000–0.065)=93.5% of the maximum possible absolute vacuum. Hence, hypothetical condensation temperatures above 180° F. are considered less desirable, whereas, hypothetical condensation temperatures below 140° F. are preferred.

Since the impregnating liquor bath surrounding the steam filled fabric is at essentially 1.0 atmosphere, the impregnating liquor will more favorably flow into the fabric to fill the voids in the fabric as steam vapor condenses to liquid water. The volume of 1.0 pound mass of saturated steam at 1.0 atmosphere equals 26.8 cubic feet. After this steam condenses to saturated liquid water at, say, 140° F., the volume of 1.0 pound mass of steam condensate equals only 0.0163 cubic foot. Hence, the volume ratio of saturated steam vapor at 212° F. divided by the volume of saturated steam condensate liquid at 140° F. equals 26.8/0.0163=1644/1. Therefore, the volume occupied by a given mass of steam condensate is negligible compared to the volume occupied by the same mass as saturated steam vapor. And, therefore, the void space in the fabric, which can easily and immediately be filled by the impregnation liquor, will be proportional to the volume of steam which can be condensed within the fabric after the fabric is submerged below the surface of the treating liquor. And furthermore, the rate at which steam can be condensed increases with a reduction in saturation pressures.

Significantly, a reduction of saturation pressure is very much dependent upon a reduction of saturation (hence condensation) temperature, i.e., in this case, the temperature of the impregnating liquor bath. And finally, the temperature of the impregnating liquid depends upon the rate at which heat is added (by the condensing steam) and the ability of the impregnating liquid to absorb and dissipate this heat through heat transfer surfaces of the impregnation vessel walls, added heat exchanger surfaces, and liquor bath vaporization to the atmosphere. Hence, to maintain sufficient heat sink capacity in the impregnating liquor bath to maintain a temperature of, say, 140° F. or less, heat exchanger surfaces may be added, if necessary, to cool the impregnation bath in the apparatus according to the present invention.

In operation, the dry fabric is conveyed to the purging device where the condensable gas is urged through the fabric as a result of a pressure differential across the batt thickness. The condensable gas displaces the non-condensable gas (air) within the fabric. The fabric is then conveyed immediately into a supply of a first impregnation liquor where the condensable gas is condensed. The condensation of the gas creates a vacuum to draw the impregnation liquor into the fabric and therefore wet the fabric.

The fabric is then preferably carried by a first conveyor belt under and over a series of rollers where the fabric is gently squeezed and released in a repetitive manner. In this way, the impregnation liquor is exchanged repeatedly within the fabric which helps to further wet the fabric in some cases, and also helps to aid in heat transfer from the steam liquor interface into the main body of the impregnating liquid batt.

SUMMARY OF ADVANTAGES OF THE PRESENT INVENTION

In the apparatus and method of the present invention, a novel approach has been made to the problem associated with entrained air within fabrics in wet-on-dry impregnation stages. By the utilization of a relatively small pressure differential, a condensable gas, especially steam, may be utilized to displace a non-condensable gas, air, so as to eliminate or greatly reduce the troublesome effect of entrained air in the fabrics.

The use of the condensable gas does not require the use of costly wetting agents. Furthermore, the path length of the fiber batt within the first impregnation tank need not be unduly lengthened in an expensive and sometimes impractical manner.

Accordingly, as a result of a relatively inexpensive treatment of the fabric while dry, the ability of the fabric to become completely wetted with the first impregnation liquor is greatly increased.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the present invention.

What is claimed is:

1. An apparatus for impregnating a dry, moving fabric with liquid, comprising:

tank means for containing a supply of the liquid;

means for conveying the fabric into and out of the tank means; and purging means for urging a condensable gas through the dry fabric immediately prior to entry of the fabric into the supply of the liquid, the purging means including both first chamber means for communicating the condensable gas with one side of the dry fabric and means for providing a pressure differential through the fabric, said means for providing the pressure differential including means for substantially sealing the dry fabric with respect to the first chamber means.

2. The apparatus of claim 1 wherein the condensable gas is steam.

3. The apparatus of claim 2 wherein the first chamber means includes a first chamber member provided on a first side of the fabric, the steam being supplied to the first chamber member at a first predetermined pressure.

4. The apparatus of claim 3 wherein the purging means further includes a second chamber member provided on a second side of the fabric substantially opposite the first chamber member, air and surplus steam being withdrawn from the fabric through the second chamber at a second predetermined pressure.

5. The apparatus of claim 4 wherein the first and second chamber members are arranged so as to define a passageway extending substantially an entire width of the fabric and extending in a machine direction, the fabric passing through the passageway of the purging means.

6. The apparatus of claim 3 wherein the first chamber member includes a rectangular frame portion having an opening to provide communication between an interior of the first chamber member and the fabric.

7. The apparatus of claim 6 wherein the purging means further includes a second chamber member provided on a second side of the fabric, the second chamber member including a rectangular frame portion having an opening with air and surplus steam being withdrawn from the fabric through the second chamber member at a second predetermined pressure.

8. The apparatus of claim 7 wherein the means for substantially sealing the dry fabric includes first and second seal members provided at the rectangular frame portions of the first and second chamber members, the first and second seal members being provided on either side of the fabric.

9. The apparatus of claim 8 wherein the first and second seal members are of polytetrafluoroethylene.

10. The apparatus of claim 1 wherein the means for conveying the fabric into and out of the tank means includes a first endless, perforate conveyor belt, the first conveyor belt carrying the fabric through the tank means.

11. The apparatus of claim 10 wherein the means for conveying the fabric into and out of the tank means includes:

a first roller member provided adjacent the steam purging means and substantially within the tank means, the first conveyor belt passing beneath the first roller member with the fabric between the first roller member and the first conveyor belt; and means for urging the belt against the first roller member whereby the fabric is squeezed between the first roller member and the first conveyor belt.

12. The apparatus of claim 11 wherein the means for urging the belt against the first roller member includes a second roller member arranged downstream of the first roller member with an uppermost portion of the second roller member provided vertically higher than a lowermost portion of the first roller member, the fabric and first conveyor belt passing over the second roller member with both the first roller member and the second roller member being substantially within the tank means.

13. The apparatus of claim 1 wherein the means for conveying the fabric includes a first roller within the tank means, the fabric passing beneath the first roller while within the supply of liquid.

14. The apparatus of claim 1 further comprising:

means for maintaining a condensable gas environment around the fabric between said purging means and said entry of the fabric into the supply of liquid.

15. A method of impregnating a dry, moving fabric with liquid, comprising the steps of:

conducting the fabric to a tank of the liquid;

supplying a condensable gas to a first chamber on a first side of the fabric immediately upstream of the liquid;

pressurizing said first chamber relative to ambient atmospheric pressure whereby a substantially uniform pressure differential is provided through the fabric throughout a first opening of the first chamber adjacent the fabric;

substantially sealing the first opening of the first chamber with respect to the fabric;

displacing a non-condensable gas in the fabric with the condensable gas of the first chamber;

immediately immersing the fabric into the liquid of the tank to condense the condensable gas within the fabric; and conducting the fabric out of the liquid of the tank.

16. The method of claim 15 further comprising the step of withdrawing the non-condensable gas and surplus condensable gas from the fabric with a second chamber on a second side of the fabric, the second chamber being located substantially opposite and adjacent to the first chamber.

17. The method of claim 16 further comprising the step of:

substantially sealing the second chamber with respect to the fabric.

18. The method of claim 15 wherein the pressure differential across the fabric is not more than 0.1 atmospheric pressure.

19. The method of claim 15 wherein the pressure differential across the fabric is not more than 0.01 atmospheric pressure.

20. The method of claim 15 wherein the condensable gas is supplied to the first chamber at a positive pressure of at least one-half inch of water.

21. The method of claim 15 further comprising the steps of:

conveying the fabric through the liquid of the tank on a first endless conveyor belt; and squeezing the fabric after immersion of the fabric into the fluid of the tank, with the fabric provided between the first endless conveyor belt and a first squeeze roller.

22. The method of claim 15 wherein the condensable gas is steam.

23. The method of claim 15 further comprising the step of:

maintaining a condensable gas environment around the fabric between displacing the non-condensable gas and immersing the fabric into the liquid.

24. An apparatus for impregnating a dry, moving fabric with liquid, comprising:

tank means for containing a supply of the liquid;

means for conveying the fabric into and out of the tank means; and purging means for urging a condensable gas through the dry fabric immediately prior to entry of the fabric into the supply of liquid, the purging means including a first chamber having a first opening, which first opening is substantially sealed with respect to one side of the dry fabric, the purging means also including means for providing a substantially uniform pressure differential through the dry fabric throughout the first opening of the first chamber.

* * * * *

UNITED STATES PATENT AND TRADEMARK OFFICE

CERTIFICATE OF CORRECTION

PATENT NO. : 4,231,129

DATED : November 4, 1980

INVENTOR(S) : Allen R. Winch

It is certified that error appears in the above-identified patent and that said Letters Patent are hereby corrected as shown below:

Column 2, line 52, delete "have" and insert therefor -- having --.

Column 3, line 1, delete "process" and insert therefor -- processes --.

Column 4, line 2, after "to dye" delete "to".

Column 7, line 10, delete "purged" and insert therefor -- purge --;
line 44, delete the numeral "104" and insert therefor -- 100 --.

Signed and Sealed this

First Day of March 1983

[SEAL]

Attest:

GERALD J. MOSSINGHOFF

Attesting Officer

Commissioner of Patents and Trademarks